US009378643B2

(12) United States Patent
Huelsen

(10) Patent No.: US 9,378,643 B2
(45) Date of Patent: Jun. 28, 2016

(54) DRIVER ASSISTANCE SYSTEM AND METHOD FOR OPERATING A DRIVER ASSISTANCE SYSTEM

(75) Inventor: Michael Huelsen, Herdecke (DE)

(73) Assignee: ROBERT BOSCH GMBH, Stuttgart (DE)

( * ) Notice: Subject to any disclaimer, the term of this patent is extended or adjusted under 35 U.S.C. 154(b) by 148 days.

(21) Appl. No.: 14/119,766

(22) PCT Filed: Apr. 2, 2012

(86) PCT No.: PCT/EP2012/055963

§ 371 (c)(1),
(2), (4) Date: Feb. 28, 2014

(87) PCT Pub. No.: WO2012/163573

PCT Pub. Date: Dec. 6, 2012

(65) Prior Publication Data

US 2014/0200798 A1 Jul. 17, 2014

(30) Foreign Application Priority Data

May 31, 2011 (DE) ..... 10 2011 076 763

(51) Int. Cl.
*G08G 1/16* (2006.01)
*G08G 1/0962* (2006.01)

(52) U.S. Cl.
CPC ..... *G08G 1/166* (2013.01); *G08G 1/09626* (2013.01)

(58) Field of Classification Search
CPC ..... G08G 1/165; G08G 1/166
See application file for complete search history.

(56) References Cited

U.S. PATENT DOCUMENTS

| | | | | |
|---|---|---|---|---|
| 2002/0022927 | A1* | 2/2002 | Lemelson | G01S 19/11 701/301 |
| 2004/0010352 | A1 | 1/2004 | Stromme | |
| 2011/0040796 | A1 | 2/2011 | Shockro et al. | |

FOREIGN PATENT DOCUMENTS

| | | | |
|---|---|---|---|
| CN | 1707224 | A | 12/2005 |
| CN | 1915725 | A | 2/2007 |
| CN | 101727759 | A | 6/2010 |
| CN | 101821788 | A | 9/2010 |
| DE | 10 2005 020429 | | 11/2006 |
| EP | 0913751 | A1 | 5/1999 |

(Continued)

OTHER PUBLICATIONS

S. Kannan et al., "An Intelligent Driver Assistance System (I-DAS) for Vehicle Safety Modelling using Ontology Approach," International Journal of UB/Comp (IJU), vol. 1, No. 3, Jul. 2010, pp. 15-29.

(Continued)

*Primary Examiner* — Mussa A Shaawat
*Assistant Examiner* — Kyung Kim
(74) *Attorney, Agent, or Firm* — Norton Rose Fulbright US LLP

(57) ABSTRACT

A driver assistance system for a vehicle including: a detection device for detecting the vehicle surroundings, a position determination device for determining a vehicle position relative to the vehicle surroundings, a database having an ontological data structure in which traffic rules are implemented, a linker for linking the detected vehicle surroundings and the vehicle position to the ontological data structure to form a linked data structure, and an evaluator for evaluating the linked data structure. Also described is a method for operating a driver assistance system for a vehicle.

10 Claims, 3 Drawing Sheets

(56) References Cited

FOREIGN PATENT DOCUMENTS

| | | |
|---|---|---|
| EP | 1 085 295 | 3/2001 |
| EP | 1 607 924 | 12/2005 |
| JP | 11-339197 | 12/1999 |
| JP | 2010-79857 | 4/2010 |
| JP | 2010-86437 | 4/2010 |
| JP | 2010122189 A | 6/2010 |

OTHER PUBLICATIONS

S. Fuchs et al., "A model for Ontology-Based Scene Description for Context-Aware Driver Assistance Systems," Ambi-sys 2008, Feb. 11-14, 2008, Quebec, Canada, 8 pages.

Georg Lutz, "Diplomarbeit in Informatik-Kollisionsvermeidung fu Fahrzeuge als Beispielanwendung fur ein ontologisches Kontextmodell," Technsiche Universitaet Muenchen, Jul. 15, 2007, pp. 1-122.

* cited by examiner

DRIVER ASSISTANCE SYSTEM AND METHOD FOR OPERATING A DRIVER ASSISTANCE SYSTEM

FIELD OF THE INVENTION

The present invention relates to a driver assistance system for a vehicle and a method for operating a driver assistance system of a vehicle.

BACKGROUND INFORMATION

Driver assistance systems for vehicles are known per se. Known driver assistance systems usually include a distance sensor for measuring a distance between the vehicle and other vehicles in the surroundings or in the proximity of the vehicle. Depending on the corresponding distance between the vehicle and the other vehicles, a warning signal is output to the driver, for example. It may also be provided that the vehicle is braked autonomously to avoid a possible collision.

In particular at intersections having multiple intersecting lanes, traffic signs, light signal systems, and multiple vehicles turning in different directions, the known driver assistance systems may generally not be used. One reason for that is, in particular, that the known driver assistance systems are usually able to detect only a few vehicles at the same time and do not have any knowledge of traffic rules which a driver of the vehicle has to comply with when participating in traffic. Such an intersection situation is therefore too complex.

SUMMARY OF THE INVENTION

An object underlying the present invention may therefore be seen as providing a driver assistance system which may also assist a driver in complex traffic situations.

The object underlying the present invention may also be seen as providing a corresponding method for operating a driver assistance system of a vehicle.

The object underlying the present invention may also be seen as providing a corresponding memory device for a driver assistance system.

These objects are achieved with the aid of the particular subject matter of the independent claims. Advantageous embodiments are the subject matter of their respective dependent subclaims.

According to one aspect, a driver assistance system for a vehicle is provided. The driver assistance system includes a detection device for detecting the vehicle surroundings and a position determination device for determining a vehicle position relative to the vehicle surroundings. Furthermore, a database is provided which has an ontological data structure having implemented traffic rules. Moreover, a linker is provided which links the detected vehicle surroundings and the vehicle position to the ontological data structure, so that a linked data structure is formed, in particular an ontological linked data structure. In particular, the linker applies the implemented axioms and/or rules to the linked data structure. This means, in particular, that the linker is configured from the linked data structure for a logical conclusion. The linker may be also configured to store the linked data structure. The linked data structure is evaluated with the aid of an evaluator in order to be able to make a statement regarding a possible collision, for example.

According to another aspect, a method for operating a driver assistance system of a vehicle is provided. Here, the vehicle surroundings and a vehicle position relative to the vehicle surroundings are detected. Furthermore, the detected vehicle surroundings and the vehicle position are linked to an ontological data structure in which traffic rules are implemented, so that a linked data structure maybe formed, in particular an ontological linked data structure. The linked data structure is subsequently evaluated.

According to another aspect, a memory device is provided in which a database having an ontological data structure is stored, traffic rules being implemented in the ontological data structure.

The present invention also, in particular, includes the idea of linking an image of a real or instantaneous situation, i.e., the vehicle surroundings and the vehicle position relative thereto, to an ontological data structure in which traffic rules are implemented. In this way, a linked data structure is advantageously formed which images the real situation within the scope of its ontological data structure. Since traffic rules are furthermore implemented in the ontological data structure, knowledge is advantageously available to be able to better assess the instantaneous situation with regard to admissible and non-admissible vehicle maneuvers, for example. For example, the driver assistance system recognizes that the vehicle must yield to another vehicle. Furthermore, the driver assistance system advantageously recognizes, in particular in complex traffic situations, e.g., intersection situations involving multiple vehicles, which vehicle must yield to which vehicle.

These findings may then be communicated, in particular visually, to the driver, for example, which may be with the aid of a display device including a warning light, for example. In particular, it may also be communicated acoustically to the driver whether or not he/she has the right of way. A display device may, in particular, include a display. A haptic way of communicating to the driver may, for example, also be provided.

In the sense of the present invention, traffic rules are, in particular, understood to mean rules which the driver must obey to be able to participate in traffic in compliance with the law.

In Germany, for example, the traffic rules in particular include the highway code [Straβenverkehrsordnung (StVO)].

An ontological data structure in the sense of the present invention includes in particular a data structure in which the data are classified or categorized and are linked to one another by relations beforehand or upon use of rules and/or axioms. This therefore may involve a heavyweight ontology, i.e., an ontology including a comprehensive use of axioms and/or rules. The ontological data structure in particular abstractly images elements of the traffic, such as roads, roadways, lanes, light signal systems, traffic signs, intersection topologies, and links them to one another, which may be by relations with the aid of rules and/or axioms. Axioms and/or rules may be right-of-way rules, for example. Axioms are, in particular, statements which are always true so that knowledge may be advantageously made available in this way. Rules, however, are not always true; they are only carried out at a certain point in time. The individual elements or pieces of data may be hierarchically structured or classified, thus forming a classification hierarchy. For example, traffic sign may in particular be a hypernym for a "yield sign" and/or for a "priority road sign."

According to the present invention, a moving object is thus detected with the aid of the detection device, for example, and classified as a vehicle, for example, when certain rule and/or axioms are met. Such a rule or axiom may, for example, say: The object is a vehicle if it is assigned to a lane. Generally speaking, rules and/or axioms which are in particular applied by the linker to the detected data are additionally stored in the database as background knowledge in order to form new relations and/or further classify the data. This classification may be, for example, a new classification or may correspond to its hierarchy.

Linking in the sense of the present invention is, in particular, understood as linking data corresponding to the detected vehicle surroundings and/or the relative vehicle position to the data of the ontological data structure.

Detecting vehicle surroundings in the sense of the present invention includes, in particular, detecting a direction in which another detected vehicle is traveling or intends to travel. For example, a flashing light of the other vehicle may be monitored, a flashing generally indicating the direction in which the other vehicle intends to travel. Detecting may, in particular, also include detecting one individual element or multiple elements or all elements of the vehicle surroundings, the element (s) then being classified as corresponding objects such as a vehicle, a lane, traffic signs, and furthermore may be provided with attributes such as position and/or velocity.

According to one specific embodiment, the instantaneous traffic situation may be stored so that it may be used for later assessments or evaluations of the then instantaneous traffic situations. Also, potential future traffic situations may be calculated and stored, in particular.

A traffic situation in particular includes a road topology such as an intersection topology, which may be one or multiple vehicles, and, for example, signal systems, in particular traffic signs.

According to one specific embodiment, the linker is configured to extract traffic elements and, for example, other vehicles, traffic signs, light signal systems, and/or roadways having one or multiple lanes, for example, from the detected vehicle surroundings and to link them to the ontological data structure, in particular to the elements of the data structure.

According to another specific embodiment, a filter is formed between the detection device and the linker for filtering elements of the detected vehicle surroundings. This makes it advantageously possible to link only certain elements of the instantaneous situation to the ontological data structure, which uses less computing power. For example, the detection device detects all drivable surfaces in the surroundings, but the filter then filters out those drivable surfaces, for example, which cannot be reached directly by the detected vehicles, for example, in the instantaneous situation. This means, in particular, that only those detected drivable surfaces are linked to the ontological data structure which may be directly reached by the detected vehicles in the instantaneous situation.

According to one specific embodiment, the implemented traffic rules and/or the underlying axioms and/or rules are expressed in such a way that only those elements of the traffic situation are considered which are assigned to recognized vehicles. In particular, right-of-way rules may only observe roadway/lane pairs, for example, to which vehicles are assigned so that right-of-way relations are only observed between vehicle pairs and not for all roadway/lane pairs.

In another specific embodiment, the detection device includes a GPS sensor and/or a radar sensor and/or a camera, e.g., a video camera or a stereo video camera, and/or a lidar sensor and/or ultrasonic sensors and/or a so-called photonic mixer device (PMD) sensor, i.e., in particular an infrared sensor for measuring a distance, or so-called time-of-flight (TOF) sensors. Detecting in the sense of the present invention includes in particular detecting by sensors. Navigation data of a navigation system may also be used for detecting the vehicle surroundings. In particular, detecting by sensors is also understood to mean that other sensor data also from external sources such as other vehicles and/or signal systems are detected and used to define or determine the vehicle surroundings. This means that in particular data corresponding to the vehicle surroundings are detected which may change in the course of time. In particular, sensors of the vehicle sensor system, e.g., a rain sensor and/or a temperature sensor, may also be used for detecting the vehicle surroundings. An angle between two roadways may be also detected.

According to another specific embodiment, it may be provided that an action is carried out as a function of the evaluated linked data structure. In particular, it may be provided that the vehicle is braked or accelerated and/or steered autonomously. A visual and/or acoustic and/or haptic warning signal may be output. In particular, a seat belt tensioning system may be activated. An airbag system may also be activated, for example. Other driver assistance systems may thus be activated so that they may, for example, carry out measures mitigating the severity of the collision in the event of a collision. A driver assistance system in the sense of the present invention may be an active or a passive system, for example. In particular, it is a comfort system or a safety system.

In another specific embodiment, the detected vehicle surroundings and/or the relative vehicle position is/are checked for consistency or validity with regard to the ontological data structure. A checking device may be provided for this purpose which may be integrated into the linker, for example. This makes it advantageously possible to recognize an error in the detection or position determination. According to the detection device, a vehicle is, for example, supposed to be present in a lane which is drivable only in the opposite direction. Linking the vehicle to the lane drivable in the opposite direction is, however, defined as not being possible or as erroneous according to the ontological data structure. A detection or position determination may thus be repeated, for example, or an error message of the sensors may be generated, for example, or a corresponding action of the driver assistance systems may be carried out, for example.

In another specific embodiment, the evaluator is integrated into the linker. A processor may be provided into which the evaluator and/or the linker and/or the filter is/are integrated. A processor maybe provided into which the evaluator and/or the linker and/or the filter is/are integrated in software. The processor is therefore configured to calculate and carry out the corresponding linkages, evaluations, and filter actions.

The present invention is described in greater detail in the following on the basis of the exemplary embodiments with reference to the drawings.

DETAILED DESCRIPTION

Figure 1:
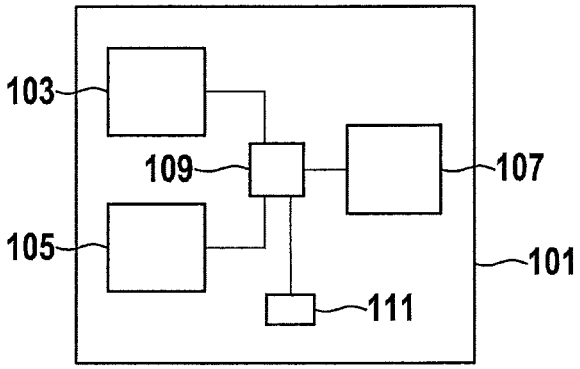
FIG. 1 shows a driver assistance system.

The same reference numerals are used below for the same features.

FIG. 1 shows a driver assistance system 101 for a vehicle (not shown). Driver assistance system 101 includes a detection device 103 for detecting the vehicle surroundings and a position determination device 105 for determining a vehicle position relative to the vehicle surroundings. The vehicle speed may be also determined. Furthermore, a database 107 is formed which has an ontological data structure having implemented traffic rules.

Driver assistance system 101 furthermore includes a linker 109 which is configured to link data corresponding to the detected vehicle surroundings and the relative vehicle position to the ontological data structure to obtain a linked data structure. This linked data structure is evaluated with the aid of an evaluator Driver assistance system 101 is thus advantageously able to detect an instantaneous or actual vehicle situation, in particular using sensors, and to image the data corresponding to this vehicle situation on an ontological data structure. Since the ontological data structure has implemented the traffic rules, it is furthermore advantageously possible for driver assistance system 101, for example, to output messages or suggestions to the driver for a driving maneuver even in complex intersection situations involving multiple traffic signs and/or light signal systems.

In a not illustrated specific embodiment, it maybe provided that position determination device 105 and detection device 103 are integrally formed as one sensor. This therefore means, in particular, that such a sensor has both functionalities.

It may, for example, be provided that user input is detected with the aid of a not illustrated input device, the user input, for example, including queries to driver assistance system 101 as to which vehicle has the right of way over which vehicle.

It furthermore may be provided that the evaluator also queries the database via the linker, for example.

In a not illustrated specific embodiment, it maybe provided that a filter is formed between detection device 103 and linker 109 which filters out certain elements from the data corresponding to the detected vehicle surroundings. Only the filtered data are then linked to the ontological data structure. Filtering has the advantage, in particular, that only data relevant to a certain vehicle situation are used for the linkage. In the traffic rules, there are, for example, elements of vehicle surroundings, such as roadways and/or lanes which have no further connection to the vehicles, and which are not relevant for an evaluation of a possible collision. This means that less data must be processed, which significantly reduces the computing time and virtually enables real-time processing.

Figure 2:
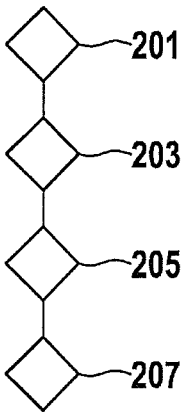
FIG. 2 shows a flow chart of a method for operating a driver assistance system.

FIG. 2 shows a flow chart of a method for operating a driver assistance system of a vehicle. In a step 201, the vehicle surroundings are detected, in particular using sensors. In a step 203, a vehicle position is detected or determined relative to the detected vehicle surroundings. In a step 205, the corresponding data of the detected vehicle surroundings and the relative vehicle position are then linked to an ontological data structure, having implemented traffic rules, so that a linked data structure is formed. In a step 207, this linked data structure is evaluated, for example, to make available messages or suggestions to a driver for a certain driving maneuver, in particular in an intersection situation.

Figure 3:
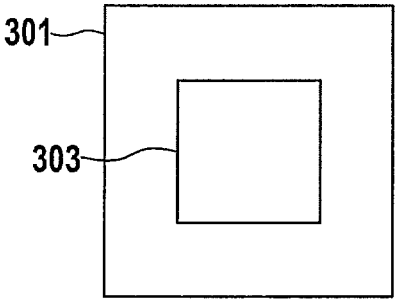
FIG. 3 shows a memory device.

FIG. 3 shows a memory device 301 in which a database 303 is stored. Database 303 includes an ontological data structure having implemented axioms and/or rules, in particular traffic rules. These axioms and/or rules (in particular traffic rules), which are stored or implemented in the database, are moreover carried out by linker 109 in particular, the results being in particular stored.

Figure 4:
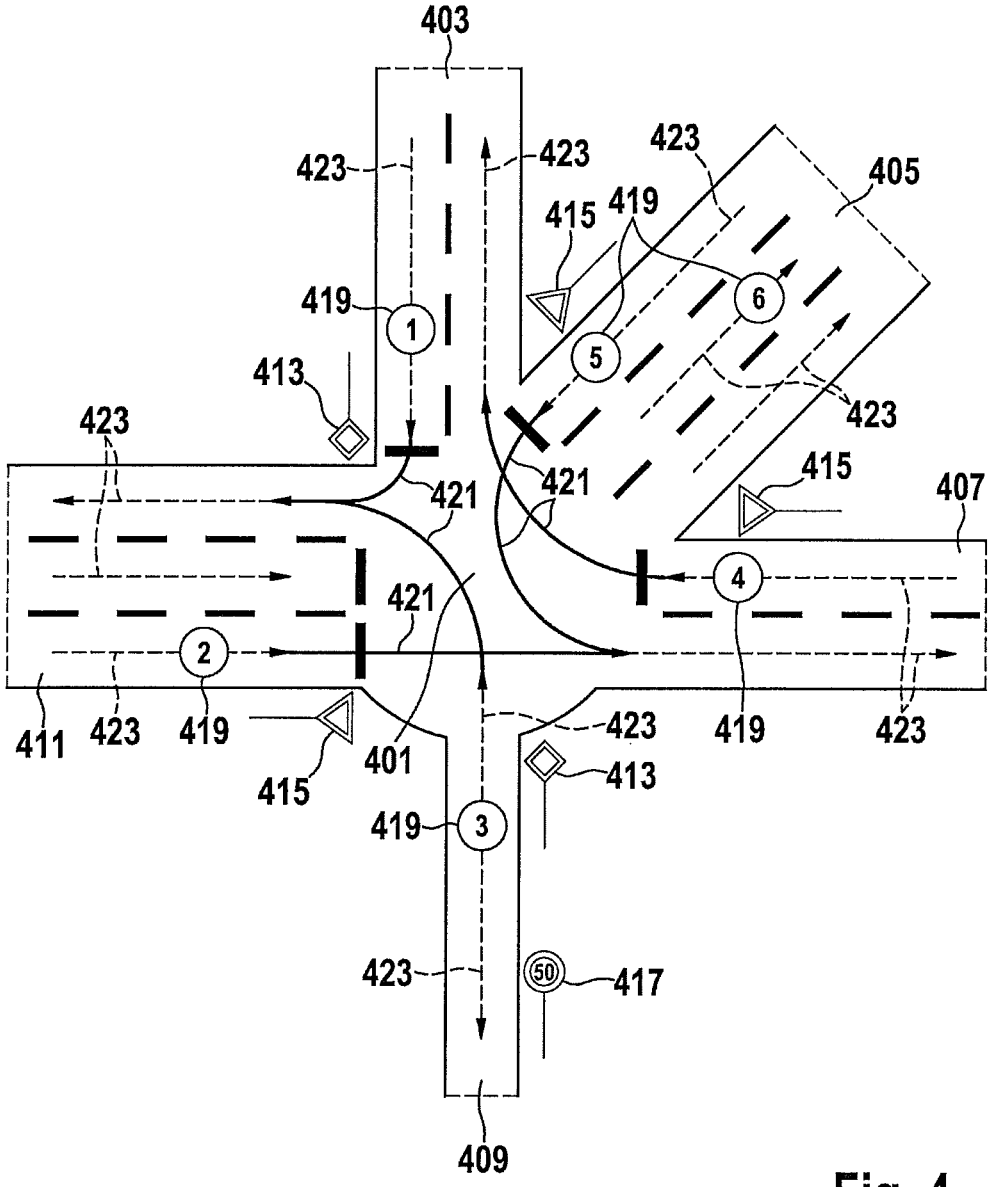
FIG. 4 shows an intersection situation.

FIG. 4 shows an intersection 401 having five intersecting roadways 403, 405, 407, 409, and 411. Traffic signs associated with roadways 403, 405, 407, 409, and 411 are symbolically indicated in the intersection area. Here, reference numeral 413 identifies a priority road sign. This therefore means, in particular, that traffic sign 413 identifies the corresponding roadway as the priority road. Reference numeral 415 indicates a yield sign. This therefore means, in particular, that traffic sign 415 indicates to a driver that he/she must yield to vehicles which come from other roadways having the right of way or to vehicles which come from the right from roadways having equal rights. Furthermore, a traffic sign 417 is also plotted which indicates a speed limit.

Vehicles in roadways 403, 405, 407, 409, and 411 are indicated by a circle having reference numeral 419, a number 1 through 6 being plotted in circle 419 in each case for better differentiability of the individual vehicles. The arrows having reference numerals 421 indicate an exemplary course of the route of corresponding vehicles 419. The arrows having reference numerals 423 indicate the lanes present in roadways 403, 405, 407, 409, and 411 and their allowed course of the route along which the vehicles are allowed to drive.

Intersection 401 may also have light signal systems additionally or alternatively to traffic signs 413, 415, and 417, although not explicitly indicated here. Also, the intersection topology and traffic situation shown here, in this case in particular the number and configuration of the vehicles, are to be understood as an example only. For example, intersection topologies having more or fewer than 5 roadways may also be provided.

Driver assistance system 101 includes the intersection situation shown in FIG. 4 and is able, due to the linkage with the ontological data structure having the implemented traffic rules, to make statements as to which vehicle must yield to which vehicle, for example. Depending on the statement, a warning or an accident-preventing action may, for example, be carried out, for example, the vehicle may be braked autonomously if the driver does not respond to a corresponding warning signal.

Figure 5:
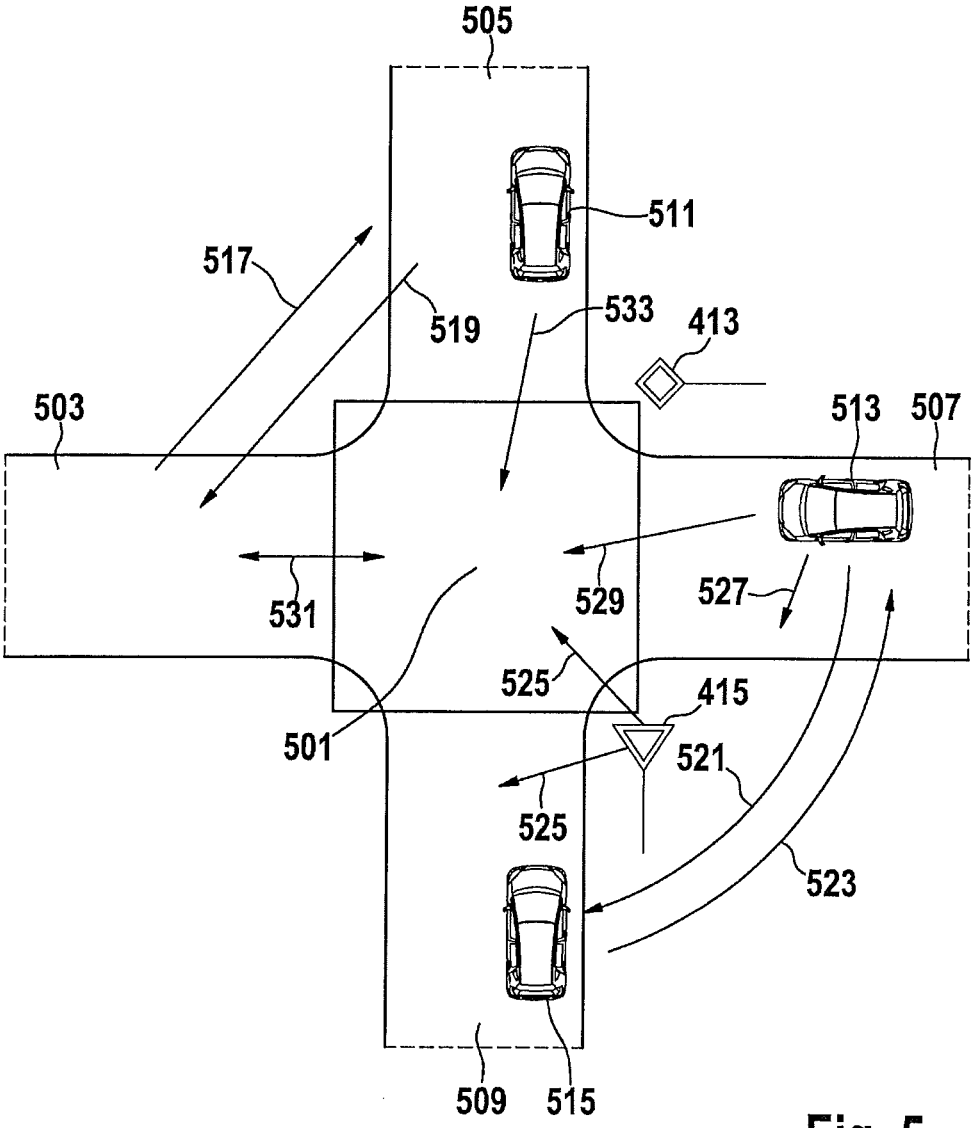
FIG. 5 shows another intersection situation.

FIG. 5 shows another intersection 501 having four intersecting roadways 503, 505, 507, and 509. A vehicle 511, which is driving away from intersection 501, is present in roadway 505. Another vehicle 513, which is approaching intersection 501, is present in roadway 507. Another vehicle 515, which is also approaching intersection 501, is present in roadway 509.

A linkage of these individual classified elements is symbolically illustrated with the aid of their relations among each other in FIG. 5 by arrows or double arrows having corresponding reference numerals which are explained in the following. These linkages are imaged in the ontological data structure, in particular.

The linkage by a relation with reference numeral 517 links the two roadways 503 and 505 and includes the information that roadway 503 is located on the right from roadway 505 viewed in the direction of intersection 501. Similarly, linkage 519 links the two roadways 503 and 505 and includes the information that roadway 505 is located on the left from roadway 503 viewed in the direction of intersection 501. The relations with reference numerals 517 and 519 exist in this form in pairs between all roadways 503, 505, 507, and 509 situated next to one another.

Furthermore, traffic sign 415 is linked to intersection 501 associated with roadway 509 which is identified by an arrow having reference numeral 525. Linkage 525 thus in particular includes the information that traffic sign 415 belongs to roadway 509 and is relevant to intersection 501.

Furthermore, a linkage 527, which in particular includes the information that vehicle 513 is present in roadway 507, is provided between vehicle 513 and roadway 507. Another linkage 529 between vehicle 513 and intersection 501 includes the information that vehicle 513 approaches intersection 501.

The linkage having reference numeral 533 indicates that corresponding vehicle 511 is driving away from intersection 501.

Yet another linkage 531 between roadway 503 and intersection 501 in particular includes the information that roadway 503 is connected to intersection 503.

Traffic signs 413 and 415 are ontologically structurally formed in such a way that a hypernym traffic sign is formed in the data structure, a hierarchy being provided in this case including a hyponym "yield sign" and another hyponym "priority road sign," in which traffic signs 413 and 415 are classified or categorized accordingly.

Linkage or relation 521 between vehicles 513 and 515 includes the information that vehicle 513 has the right of way over vehicle 515. Linkage 523 between vehicles 515 and 513 includes the information that vehicle 515 must yield to vehicle 513. This information is in particular generated by the linker and the ontological data structure and may be stored in the ontological data structure.

The examples and traffic situations explained above as well as the intersection topologies are to be understood as examples only. For example, more or fewer roadways may be present than shown in the figures. In particular, a vehicle number may also be different. The present invention is therefore applicable in all variants at any complexity.

To sum up, the present invention in particular includes the idea of making information, in particular also traffic rules, available to a driver assistance system with the aid of a linker so that an actual traffic situation, e.g., at an intersection, may be evaluated, among other things, with regard to the traffic rules, but in particular also with regard to who drives where, what is the signal system phase, i.e., in particular instantaneous information on the situation, in order to be able, for example, to provide messages or suggestions for driving maneuvers in compliance with the law or to steer and/or brake the vehicle autonomously in the event of a hazardous situation. Due to the traffic rules in particular being implemented in an ontological data structure, a processing of the detected traffic situation may take place by the traffic rules being taken into account by the ontological data structure, without the need for using other external algorithms for this purpose. Here, an ontology is in particular a formalization or is used to describe a knowledge base.

What is claimed is:

1. A driver assistance system for a vehicle, comprising:
- a detection device to detect the vehicle's surroundings;
- a position determination device to determine a vehicle position relative to the vehicle's surroundings;
- a database having an ontological data structure that implements traffic rules, which drivers must obey to participate in traffic in a legally compliant manner, in a hierarchical structure in which the hierarchically arranged elements are associated with respective situational inter-object relationships;
- a linker to link the detected vehicle surroundings and the vehicle position to relative portions of the ontological data structure to form a linked data structure; and
- an evaluator to evaluate the linked data structure.

2. The driver assistance system of claim 1, wherein a filter is formed between the detection device and the linker for filtering elements of the detected vehicle surroundings.

3. The driver assistance system of claim 1, wherein a checking device is formed for checking at least one of the detected vehicle surroundings and the relative vehicle position for consistency with the ontological data structure.

4. The driver assistance system of claim 1, wherein the detection device includes at least one of a GPS sensor, a radar sensor, a stereo video camera, a lidar sensor, an ultrasonic sensor, a PMD sensor, and a camera.

5. The driver assistance system of claim 1, further comprising a processor configured to carry out an action as a function of the evaluated linked data structure.

6. The driver assistance system of claim 5, wherein the action is at least one of braking the vehicle, accelerating the vehicle, steering autonomously, outputting a warning signal, tensioning a seat belt, and activating an airbag.

7. A method for operating a driver assistance system of a vehicle, the method comprising:
- detecting the vehicle's surroundings;
- detecting a vehicle position relative to the vehicle's surroundings;
- linking the detected vehicle surroundings and the vehicle position to an ontological data structure that implements traffic rules, which drivers must obey to participate in traffic in a legally compliant manner, in a hierarchical structure in which the hierarchically arranged elements are associated with respective situational inter-object relationships, thereby forming a linked data structure; and
- evaluating the linked data structure.

8. The method of claim 7, wherein elements are filtered out from the detected vehicle surroundings and the filtered detected vehicle surroundings are linked to the ontological data structure.

9. The method of claim 7, wherein at least one of the detected vehicle surroundings and the relative vehicle position is checked for consistency relating to the ontological data structure.

10. A memory device for a driver assistance system, comprising:
- a database including an ontological data structure that implements traffic rules, which drivers must obey to participate in traffic in a legally compliant manner, in a hierarchical structure in which the hierarchically arranged elements are associated with respective situational inter-object relationships;
- the driver assistance system being for a vehicle and including:
  - a detection device to detect the vehicle's surroundings;
  - a position determination device to determine a vehicle position relative to the vehicle's surroundings;
  - a linker to link the detected vehicle surroundings and the vehicle position to the ontological data structure to form a linked data structure; and
  - an evaluator to evaluate the linked data structure.

* * * * *